United States Patent [19]

Donovan

[11] Patent Number: 4,544,365

[45] Date of Patent: Oct. 1, 1985

[54] PUPPET

[76] Inventor: James E. Donovan, 813 West Ave., Buffalo, N.Y. 14213

[21] Appl. No.: 556,972

[22] Filed: Dec. 1, 1983

[51] Int. Cl.[4] ..... A63H 3/20; A63H 3/14

[52] U.S. Cl. ..... 446/73; 446/77; 446/329; 446/362

[58] Field of Search ..... 446/71, 72, 73, 77, 446/79, 80, 327, 328, 329, 339, 340, 341–487; 248/467, 489, 493

[56] References Cited

U.S. PATENT DOCUMENTS

| | | | |
|---|---|---|---|
| 222,571 | 12/1879 | Carlin | 446/327 |
| 2,155,665 | 4/1939 | Leeper | 446/327 |
| 2,433,555 | 12/1947 | Hulse | 446/327 |
| 2,530,610 | 11/1950 | Genone | 446/327 X |
| 2,571,744 | 10/1951 | Midouhas | 446/73 |
| 3,521,399 | 7/1970 | Deal | 446/73 X |
| 4,326,356 | 4/1982 | Mason | 446/73 X |

*Primary Examiner*—F. Barry Shay
*Attorney, Agent, or Firm*—James J. Ralabate

[57] ABSTRACT

A puppet constructed from a hamburger container having a hinged lid.

Finger-receiving means are provided as holes in the container or as cylindrical portions to be attached to it. Face portions may be drawn or constructed and attached to the container. A string may be attached to the lower portion, passed out through the upper portion and attached to a wall by means of tape to hang the puppet. An attachment may be attached to the container as a puppet body. Movable arms on the body may be made to move by means of string running from the arms to the lid. The attachments may be provided as cutout portions on a placemat.

8 Claims, 5 Drawing Figures

PUPPET

This invention relates to a toy puppet and a method for constructing same. More particularly, this invention involves the use of a conventional hamburger container to form the toy puppet.

BACKGROUND OF THE INVENTION

This invention involves using conventional materials to construct a toy puppet.

Hand puppets can be purchased in a completed form ready for use. These toy puppets range from relatively simple constructions to those toy puppets of very complex professional construction having moving parts and even approaching life-like appearances. These puppets usually comprise the basic components of a head or face portion and in many instances a body portion. The puppets usually simulate a human or animal or some other real or imaginary creature. The simple puppets usually comprise a simple piece of cloth attached to a molded head. The hand or fingers are then inserted into the head to permit head movement. The more sophisticated puppets include elaborate devices having moving hands, eyes, etc., some of which can be moved by hand and others require power batteries or other means of power.

In both the simple and professional puppets the structures are completed and ready for use. There is a need for a simple inexpensive puppet that can be constructed easily by children thereby permitting not only enjoyment in use but also enjoyment in constructing or building the puppet. This simple puppet must not only be capable of being made easily by children but must also be capable of being easily manipulated by them. Thus, the prior art does not provide a simple economical hand-operated puppet than can be easily and enjoyably constructed from conventional materials and can be easily manipulated by children.

SUMMARY OF THE INVENTION

It is therefore an object of this invention to provide a puppet devoid of the above-noted disadvantages.

Another object of this invention is to provide a toy that can be easily constructed from conventional readily available materials.

Still another object of this invention is to provide a puppet that can be hand operated and manipulated to simulate mouth movements.

Another still further object of this invention is to provide a puppet that can be easily constructed from a hamburger container and a placemat commonly found in fast food restaurants.

Another yet further object of this invention is to provide a puppet that can easily receive attachments or add on features such as faces, teeth, noses, bodies and the like.

Another yet additional object of this invention is to provide a toy puppet that is enjoyable and very economical to construct and simple to use by children.

Yet still a further object is to provide an invention that allows children to construct a puppet in a variety of ways using their individual ingenuity, imagination and personal skills.

The foregoing objects and others are accomplished in accordance with this invention by providing a puppet that is constructed from a conventional polystyrene or styrofoam container of the type found in fast food restaurants. These containers generally are designed so that the upper portion or lid is hinged to the lower portion of the structure. This feature is utilized to simulate the mouth portion of the puppet. In the back area of the container adjacent the hinged portion, finger holes are provided to facilitate movement of the upper lid from the lower portion. In lieu of finger holes other means to accommodate the fingers can be used such as cylinders mounted on either the above or below surfaces of the container. Another alternate way to accommodate the fingers would be to attach strings or rubber bands to these upper and lower surfaces. Pieces of tape can also be used whereby the fingers will adhere to the two-way tape and thereby move the lid open or closed. In the front area of the container, that is the side opposite to the backed hinged area, is provided attachment means for the face segment of the puppet. The face segment is in two pieces, the lower face piece attached to the lower portion of the container, and the upper face piece attached to the upper or lid portion of the container. Thus, when the lid is opened or closed the face pieces will separate thus simulating a mouth opening and closing. Any suitable attachment means may be used to connect the face segments to the polystyrene or styrofoam container. Typical attachment means include two-way tape, conventional tapes, glues or other adhesives. The face portion can be that of a cartoon character, animal or other creature. By punching finger holes or using other means in the back part of the container adjacent the hinged portion, the puppet can be easily manipulated by opening and closing the container. Tape or other means may be attached on the center or other portions of the container to improve the strength of the carton or container when used. The face or body portion of the puppet can be supplied from a placemat also similar to that used in fast food restaurants. The mats can contain cutouts that can easily be used as attachments to the container to form the toy puppet. Various means can also be included to facilitate hanging the puppet on a wall or other surfaces. A simple method would be to attach a string to a cardboard piece inside the container and extend the string to the exterior for mounting or attaching to a wall. This feature will be discussed later in relation to the drawings. After the two-piece face portion has been attached and any body portion, fingers may be inserted in the finger holes positioned above and below the hinged area so that when the hand opens and closes a simulated mouth movement is imparted to the puppet.

DESCRIPTION OF THE DRAWINGS AND THE PREFERRED EMBODIMENT

Figure 1A:
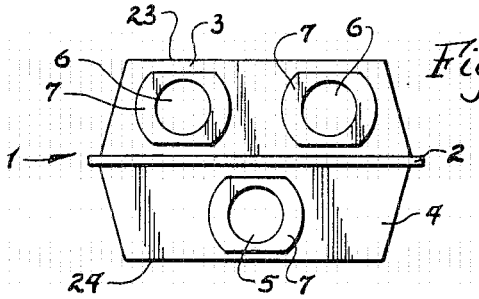
FIGS. 1*a* and 1*b* are views of the back portions of the styrofoam hamburger container having finger holes or, alternatively, other finger accommodations provided therein.
Figure 1B:
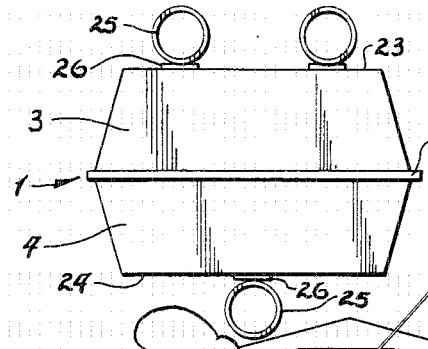

FIG. 1 illustrates a conventional hamburger styrofoam container 1 having at its back portion a hinged section 2 which facilitates opening and closing of the container lid 3. The bottom section 4 of the container 1 is provided with at least one finger hole 5 and the top lid 3 is provided with one or two finger holes 6. By inserting the fingers into fingerholes 5 and 6, the container 1 can be easily opened or closed. As an alternative to finger holes 5 and 6, other finger accommodations can be made in the back portion of container 1. Cylindrical cardboard (or other material) attachments can be connected to top surface 23 and bottom surface 24 of container 1. Rubber bands, string or other means having finger openings can be used in place of cardboard cylinders 25, opened on at least one end. These cylinders or other means can be attached to container 1 by glue, two-way tape or other attachment means 26. When the term "finger holes" is used throughout this disclosure and/or in claims, it is intended that any finger accommodations be included such as the cylinders, strings or rubber bands disclosed earlier herein. This back portion of container 1 with finger holes can be provided with aperture strengtheners 7 to impart structural strength to the area of container 1 intermediate to or around any finger holes. In addition, other materials such as cardboard or wood may also be attached to the center portion of the container to strengthen the container if it is desired. Finger holes 5 and 6 may be formed in the back surface of container 1 by using a sharp piercing object such as a tooth pick or pin to form punctures defining the area to be punched out. Also, the apertures may be selectively cut out if a particular configuration is desired.

Figure 2:
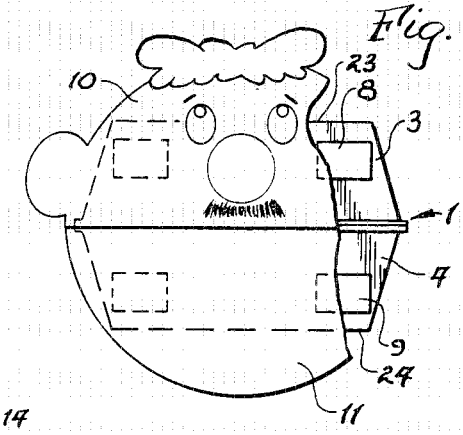
FIG. 2 is a cutaway view of the face portion attached to the front portion of the styrofoam hamburger container including the upper and lower face segments attached thereto.

FIG. 2 illustrates by a cutaway schematic the front or open (unhinged) part of conventional design container 1, on the end or surface opposite to the back or hinged portion. On the upper lid 3 two-way tape 8 is attached on both sides at positions at about the same level or plane. Two-way tape 9 is also attached on the lower container portion 4 at about the same location from the container edge. A two-section face having an upper segment 10 and a lower segment 11 is then attached to the container 1 via tape portions 8 and 9. The top 10 part of the head is pressed to the tape 8 on the top 3 half of carton, and the bottom 11 part of the head is pressed onto the tape 9 mounted on the bottom portion 4 of the styrofoam carton or container. As lid is opened or closed by using finger holes 5 and 6, the upper part of the head piece 10 is separated from the lower part of the head piece 11 simulating mouth movement. The head pieces or face portions 10 and 11 may be constructed from any suitable material; typical materials are paper, cardboard, cloth, plastic or styrofoam or any plastic or synthetic material. The tongue, nose, eyes, mouth, eyebrows, etc. may be painted or drawn on, or may be constructed from cloth, plastic or synthetic materials, beads, rubber, or maybe objects such as buttons, balloons or the like.

Figure 3:
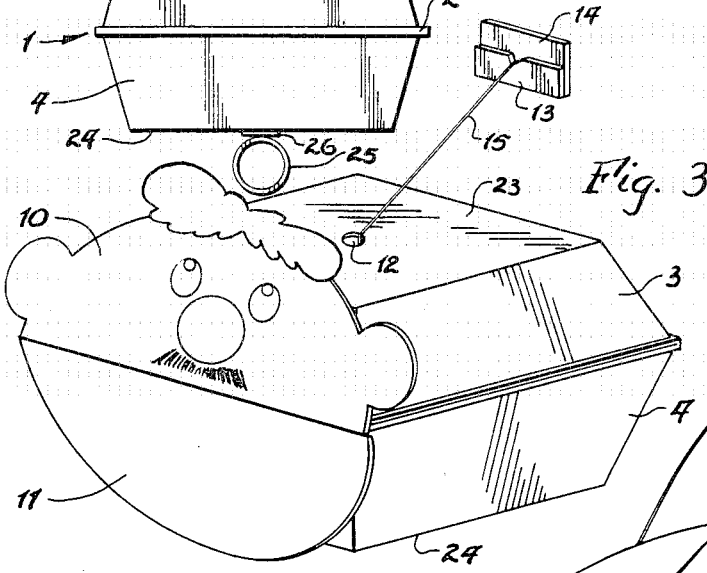
FIG. 3 is a perspective view of the hamburger container after the face segments have been attached thereto, and a wall attachment means is included therewith.

In FIG. 3 a side perspective view of the puppet is shown after the upper 10 and lower 11 face portions have been connected to the carton top 3 and carton bottom 4. If it is desired to mount the puppet on a wall or other object, FIG. 3 shows one method for accomplishing this. An aperture 12 is punched into the top portion 3 of the container. A string, thread or other connecting means 15 is attached at one end to a cardboard or wood square 13 having two-way tape 14 attached thereto. The tape is pressed against the wall to hang the puppet. On the opposite end of string 15 is a plug or square similar to wall plug 13 which is attached to any portion of the interior of container 1. It should be noted, however, that while the preferred embodiment has a wall attachment or hanging means comprising two plugs 13 and string 15, it is not necessary to this invention that a wall attachment means be utilized.

Figure 4:
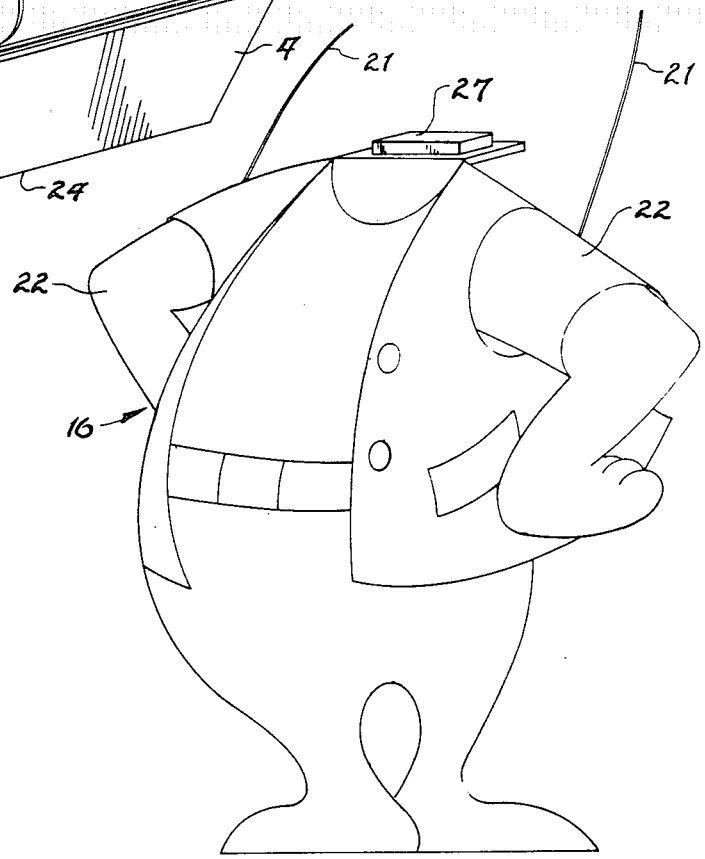
FIG. 4 is a front elevational view of a body portion that can be attached to the hamburger container to enable the container to be used as a completed hand puppet.

In FIG. 4 a body attachment 16 is shown having an upper tab portion 17 containing a piece of two-way tape 18. The tab 16 is bent, folded or creased at fold 19 to permit easier attachment to the under portion 24 of container 1. Strings or other means 21 may be used to simulate arm or leg movement of the body portion. The string 21, for example, can be attached to the arm 22 on one end and to the lid 3 and bottom portion 4 of the container on the other end. Thus, when the container is hand operated to open and close both arms 22 will move as will face portions 10 and 11. The body 16 can be constructed of cloth, paper, cardboard, plastic, can be cloth filled, or made from various objects such as balloons and the like.

An ideal system would be to have cutout portions on a placemat used in fast food restaurants. The placemat together with the hamburger container would then be used to make the complete puppet of this invention. Tape or other objects may be used to strengthen the container since styrofoam containers have a tendency to crumble if pressure is exerted thereon. The container used in fast food restaurants generally has an upper portion generally of planar material with a mating portion at the bottom. The sides of the container are upright and inclined inwardly from the bottom to the top forming a generally truncated quadrangular pyramid shape or configuration. The lower portion or compartment is constructed so that it will mate with the upper portion when closed. The puppets of this invention can simulate a human or animal or some other real or imaginary creature. While the specific details of this invention have been set out for clarity in the description and drawings, they are for purposes of illustration and not limitation. The puppet of this invention is not limited to the precise details and configurations disclosed and many variations and ramifications will become apparent to one skilled in the art upon a reading of this disclosure. These variations are intended to be included within the scope and spirit of this invention.

I claim:

1. A hand-operated puppet constructed from a hamburger container having an upper lid member, a lower lid member and means hingedly joining said members, comprising a face attachment attached to said container and finger accomodation means on said parts in working relationship to the hinge joint of said container, said face attachment being provided on the front portion of said container and said finger accomodation means being provided on the back hinged portion of said container, said finger accomodation means being positioned at least one in or on the upper lid back portion of the container and at least one in or on the lower bottom back portion of the container, said face attachment being in two parts, one part connected to the front lid portion of the container and the other face part connected to the front lower portion of the container, said finger accomodation means being adapted to permit said container to be one-handedly manipulated to open and and closed positions to represent opening and closing a mouth portion of said puppet, and wherein a puppet body portion is attached to the lower section of said container said puppet body portion having at least one limb movably connected thereto, and means connecting said limb to said container for causing movement of said limb relative to said body portion when said members are moved relative to each other.

2. The puppet of claim 1 wherein said finger accomodation means comprise finger holes positioned in said container.

3. The puppet of claim 1 wherein means are incorporated therein for suspending said puppet on a wall or other planar surface.

4. The puppet of claim 1 wherein said container is reinforced by means adapted to improve the strength of said container.

5. The puppet of claim 1 wherein the finger accomodation means comprise a cylindrical device opened on at least one end and attached along its peripheral portion to the container.

6. The puppet of claim 1 wherein the finger accomodation means comprise rubber bands attached to the top and bottom portions of said container.

7. The puppet of claim 1 wherein said face and a body portion are cut out from a placemat.

8. The puppet of claim 1 wherein said face and body attachments are removable from said container.

* * * * *